US012428800B2

(12) United States Patent
Scheirer

(10) Patent No.: US 12,428,800 B2
(45) Date of Patent: Sep. 30, 2025

(54) APPARATUS TO SECURE ANGLE OF HYDRAULIC COUPLING CONNECTIONS

(71) Applicant: Caterpillar Inc., Peoria, IL (US)

(72) Inventor: Jacob Andrew Scheirer, Tomball, TX (US)

(73) Assignee: Caterpillar Inc., Peoria, IL (US)

( * ) Notice: Subject to any disclaimer, the term of this patent is extended or adjusted under 35 U.S.C. 154(b) by 570 days.

(21) Appl. No.: 17/814,273

(22) Filed: Jul. 22, 2022

(65) Prior Publication Data

US 2024/0026633 A1 Jan. 25, 2024

(51) Int. Cl.
*E02F 3/36* (2006.01)
*E02F 9/22* (2006.01)

(52) U.S. Cl.
CPC ..... *E02F 3/3654* (2013.01); *E02F 9/2267* (2013.01); *E02F 9/2275* (2013.01)

(58) Field of Classification Search
CPC ..... E02F 3/3654; E02F 3/7604; E02F 9/2267; E02F 9/2275
USPC ..... 137/899; 138/109
See application file for complete search history.

(56) References Cited

U.S. PATENT DOCUMENTS 3,600,012 A * 8/1971 Stafford ..... F16L 23/0286 285/413
4,023,836 A * 5/1977 Applehans ..... F16L 23/032 285/368
4,239,262 A 12/1980 Krupp et al.
4,320,783 A * 3/1982 Neal ..... E02F 9/2275 414/696
5,671,779 A * 9/1997 Koishikawa ..... B63H 20/245 123/195 P
6,619,331 B1 * 9/2003 Suchdev ..... F01P 11/04 138/121
7,946,624 B2 5/2011 Sakakibara et al.
8,820,361 B2 * 9/2014 Kawasetsu ..... F16L 9/133 138/109
8,899,533 B2 12/2014 Lucas et al.
9,688,348 B2 6/2017 Nakakura
11,118,711 B1 9/2021 Dresang et al.
2014/0003901 A1 * 1/2014 Takagi ..... E02F 3/30 414/687
2014/0077493 A1 * 3/2014 Lawson ..... F16L 27/0845 285/368
2014/0252179 A1 * 9/2014 Go ..... E02F 9/14 248/74.1
2017/0184228 A1 * 6/2017 Kotrla ..... E21B 33/06
2017/0321730 A1 * 11/2017 Kobayashi ..... F16F 9/54
2020/0200307 A1 6/2020 Kesler et al.

* cited by examiner

*Primary Examiner* — Kelsey E Cary

(57) ABSTRACT

In some implementations, a hydraulic coupling connection, defined between a hose and a valve of a machine, includes: a split flange configured to be engaged with a coupling disposed at an end of the hose; a plurality of fasteners disposed through corresponding openings in the split flange, wherein the plurality of fasteners are configured to secure the split flange and the coupling to a body of the valve; and a bracket secured with the split flange, via first and second fasteners, of the plurality of fasteners, disposed through corresponding openings in the bracket, wherein the bracket is configured to secure the connection at a first angle.

20 Claims, 4 Drawing Sheets

APPARATUS TO SECURE ANGLE OF HYDRAULIC COUPLING CONNECTIONS

TECHNICAL FIELD

The present disclosure relates generally to hydraulic coupling connections and, for example, to an apparatus that secures hydraulic coupling connections at a certain angle.

BACKGROUND

Machines, such as track-type tractors, and systems, such as implement control systems, may use flowlines (e.g., a hydraulic hose) to route fluid (e.g., hydraulic fluid) between different parts and/or components. The hose may have a coupling connection at each end to secure the hose to the different components.

Generally, because the work area associated with coupling connections is a cramped area with little clearance, installers have to be careful that the hose does not contact other parts (e.g., other hoses or sheet metal) to avoid damage (e.g., breakage) caused by rubbing and/or vibration, which may result in fluid leakage and/or system downtime for making repairs. Generally, the connection can be set at any angle. The task of connecting the hose at a certain angle (e.g., to avoid contact with other parts) is thus inefficient, physically taxing, and time-consuming.

The apparatus of the present disclosure solves one or more of the problems set forth above and/or other problems in the art.

SUMMARY

In some implementations, an earthmoving machine includes: a frame; one or more implements mounted on the frame; an engine configured to power the machine; ground engaging members configured to propel the machine; and an implement control system configured to control the one or more implements, wherein the implement control system includes: a pump configured to supply fluid, at pressure, to the one or more implements; a valve configured to supply fluid, at pressure, from the pump, selectively to the one or more implements; a first hose connected between the pump and the valve, wherein a connection defined between the first hose and the valve includes: a coupling disposed at an end of the first hose; a split flange engaged with the coupling; a plurality of fasteners disposed through corresponding openings in the split flange, wherein the plurality of fasteners are configured to secure the split flange and the coupling to a body of the valve; and a bracket secured with the split flange, via first and second fasteners, of the plurality of fasteners, disposed through corresponding openings in the bracket, wherein the bracket is configured to secure the connection at a first angle; and a second hose connected between the valve and a first implement of the one or more implements.

In some implementations, a hydraulic coupling connection, defined between a hose and a valve of a machine, includes: a split flange configured to be engaged with a coupling disposed at an end of the hose; a plurality of fasteners disposed through corresponding openings in the split flange, wherein the plurality of fasteners are configured to secure the split flange and the coupling to a body of the valve; and a bracket secured with the split flange, via first and second fasteners, of the plurality of fasteners, disposed through corresponding openings in the bracket, wherein the bracket is configured to secure the connection at a first angle.

In some implementations, an apparatus, for a hydraulic coupling connection defined between a hose and a valve of a machine, the hydraulic coupling connection including a split flange configured to be engaged with a coupling disposed at an end of the hose, includes: a bracket configured to be secured with the split flange, via first and second fasteners, of a plurality of fasteners, wherein the first and second fasteners are configured to be disposed through corresponding openings in the bracket, the split flange, and a body of the valve, and wherein the bracket is configured to secure the connection at a first angle.

DETAILED DESCRIPTION

This disclosure relates to a bracket 310, which is applicable to any machine or system that includes coupling connections (e.g., hydraulic coupling connections). The term "machine" may refer to any machine that performs an operation associated with an industry such as, for example, mining, construction, farming, transportation, or another industry. For example, the machine may be an earthmoving machine (e.g., a track-type tractor, motor grader, or wheel loader) and/or other machines. One or more implements may be connected to the machine. Example systems may include an implement control system associated with the one or more implements of the machine, an engine, a genset, and/or other systems.

Figure 1:
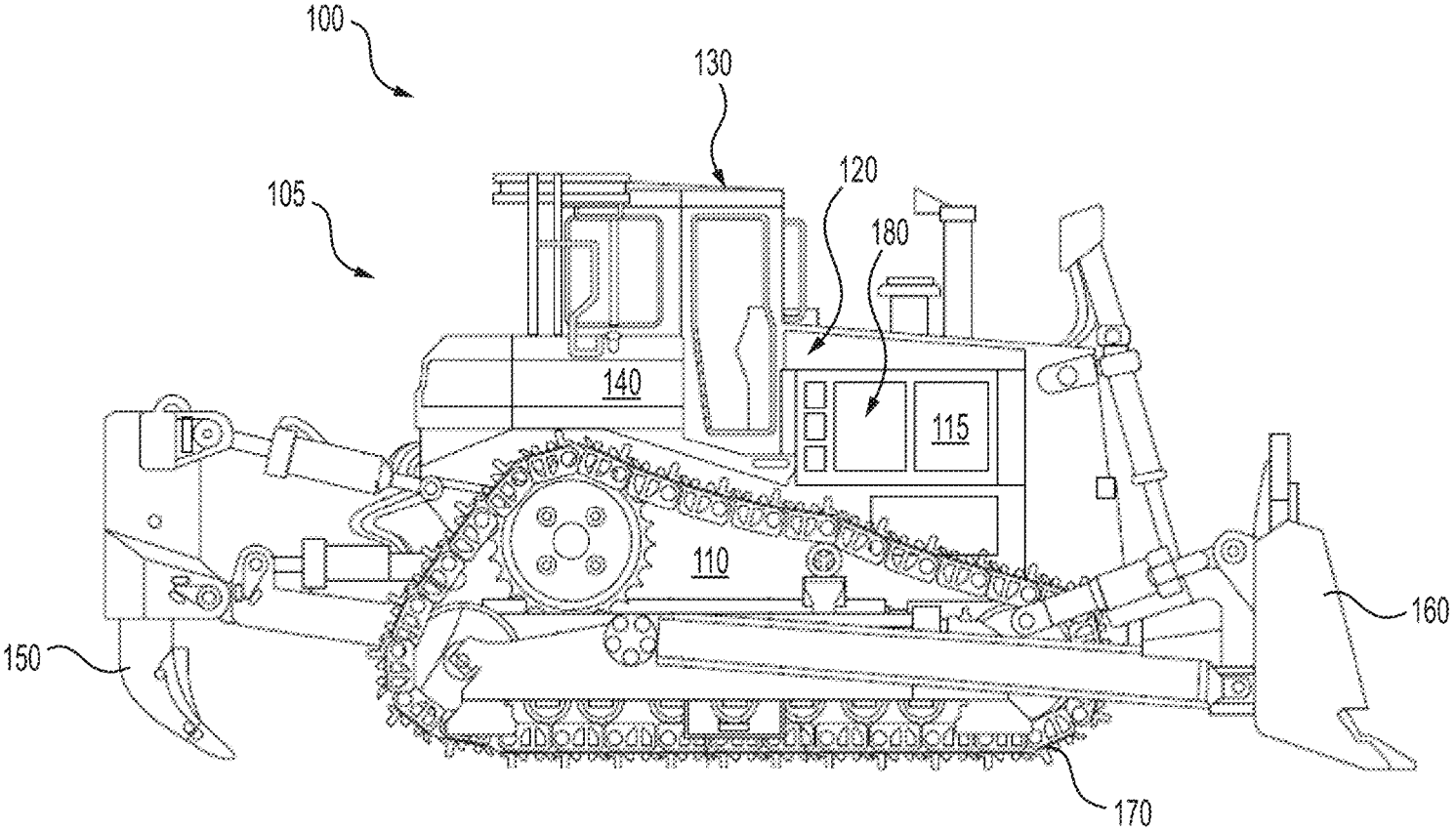
FIG. 1 is a diagram of an example implementation described herein.

FIG. 1 is a diagram of an example implementation 100 described herein. For example, FIG. 1 depicts a side view of an earthmoving machine 105, namely a track-type tractor (or dozer). Alternatively, the machine 105 may be another type of track-type machine, such as an excavator, among other examples. As shown in FIG. 1, the example implementation 100 includes at least the machine 105 and an implement control system 180 associated with the machine 105.

As shown in FIG. 1, the machine 105 includes a frame 110. The machine may include, mounted on the frame 110, an engine 115, a sensor system 120, an operator cabin 130, a controller 140, a rear attachment 150 and/or a front attachment 160 (which also may be referred to as "implements"), ground engaging members 170, and the implement control system 180.

The engine 115 may include an internal combustion engine, such as a compression ignition engine, a spark ignition engine, a laser ignition engine, or a plasma ignition engine, among other examples. The engine 115 provides power to the machine 105 and/or a set of loads (e.g., components that use power to operate) associated with the machine 105. For example, the engine 115 may provide power to the sensor system 120, the operator cabin 130, one or more control systems (e.g., the controller 140), the ground engaging members 170, and/or the implement control system 180.

The engine 115 can provide power to an implement of the machine 105 (e.g., the rear attachment 150 and/or the front attachment 160), such as an implement used in mining, construction, farming, transportation, or any other industry. For example, the engine 115 may power components (e.g., one or more hydraulic pumps, one or more actuators, and/or one or more electric motors) to facilitate control of the rear attachment 150 and/or the front attachment 160 of the machine 105.

The sensor system 120 may include sensor devices that are capable of generating information regarding an amount of wear of one or more components of the machine 105, an operation of the machine 105, a pose of the machine 105, and/or an environment of the machine 105, among other examples.

The operator cabin 130 may include an integrated display and operator controls. The operator controls may include one or more input components (e.g., integrated joysticks, push-buttons, control levers, and/or steering wheels) to control an operation of the machine 105. For an autonomous machine, the operator controls may not be designed for use by an operator and, rather, may be designed to operate independently from an operator. For example, the operator controls may include one or more input components that provide input instructions for use by another component without any operator input.

The controller 140 (e.g., an electronic control module) may control and/or monitor operations of the machine 105. For example, the controller 140 may control and/or monitor the operations of the machine 105 based on information from the operator controls and/or from the sensor system 120.

The rear attachment 150 may include a ripper assembly, a winch assembly, and/or a drawbar assembly, among other examples. The front attachment 160 may include a blade assembly, among other examples.

The ground engaging members 170 may be configured to propel the machine 105 across a ground surface. The ground engaging members 170 may include wheels, tracks, and/or rollers, among other examples, for propelling the machine 105. In some instances, the ground engaging members 170 may be associated with an undercarriage that includes tracks (as shown in FIG. 1).

The implement control system 180 can control an implement of the machine 105 (e.g., the rear attachment 150 and/or the front attachment 160). The implement control system 180 may include one or more pumps, valves, and/or hoses (as described in more detail below in connection with FIG. 2).

As indicated above, FIG. 1 is provided as an example. Other examples may differ from what was described in connection with FIG. 1.

Figure 2:
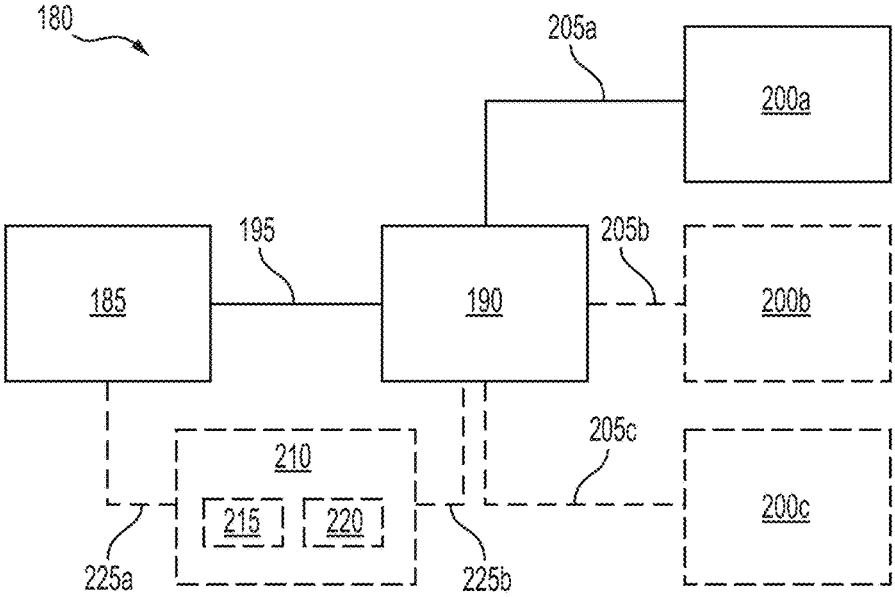
FIG. 2 is a diagram of an example implement control system described herein.

FIG. 2 is a diagram of an example implement control system 180 described herein. In some examples, the implement control system may include less equipment, additional equipment, or alternative equipment compared to the example system depicted in FIG. 2. As shown in FIG. 2, the example implement control system 180 includes a pump 185, a valve 190, a hose 195 connected between the pump 185 and the valve 190, and one or more implements 200*a*-200*c* connected to the valve 190 via respective hoses 205*a*-205*c*.

The pump 185 may include a hydraulic pump for supplying fluid (e.g., hydraulic fluid) at pressure, from a fluid source, to the one or more implements 200*a*-200*c*, via the valve 190.

The valve 190 may include a hydraulic control valve (e.g., a directional control valve, a pressure control valve, or a flow control valve, among other examples) for supplying fluid at pressure, from the pump 185, selectively to the one or more implements 200*a*-200*c*.

The term "hose" may refer to any flowline that may be associated with a machine and/or system, such as, for example, any type of fluid conduit, pipe, and/or other types of flowlines. The hose 195 (which may be similar to the hoses 205*a*-205*c*) may include a high-pressure-rated hydraulic hose (e.g., a steel fiber-reinforced rubber hose), among other examples.

The one or more implements 200*a*-200*c* may include a ripper assembly, a winch assembly, a drawbar assembly, and/or a blade assembly (e.g., corresponding to the rear attachment 150 and/or the front attachment 160 of the machine 105 shown in FIG. 1). The one or more implements 200*a*-200*c* may include one or more actuators (e.g., hydraulic cylinders) configured to actuate the respective implements 200*a*-200*c*.

Each one of the hoses 205*a*-205*c* depicted schematically in FIG. 2 may define a plurality of separate directional flow paths associated with the one or more actuators of the respective implements 200*a*-200*c*. For example, the hose 205*a* (which may be similar to the hoses 205*b*-205*c*) may represent a pair of hoses connected between the valve 190 and the respective implement 200*a*, and may be configured to actuate the respective actuator of implement 200*a* in first and second opposite directions.

The implement control system 180 may include a controller 210. The controller 210 may be in data communication with the pump 185 and/or the valve 190. The controller 210 may include memory 215 and one or more processors 220 configured to implement instructions for controlling the pump 185 and/or the valve 190, via respective communication links 225 (225*a*-225*b*). In some examples, the pump 185 and/or the valve 190 may be controlled manually.

As indicated above, FIG. 2 is provided as an example. Other examples may differ from what was described in connection with FIG. 2.

Figure 3:
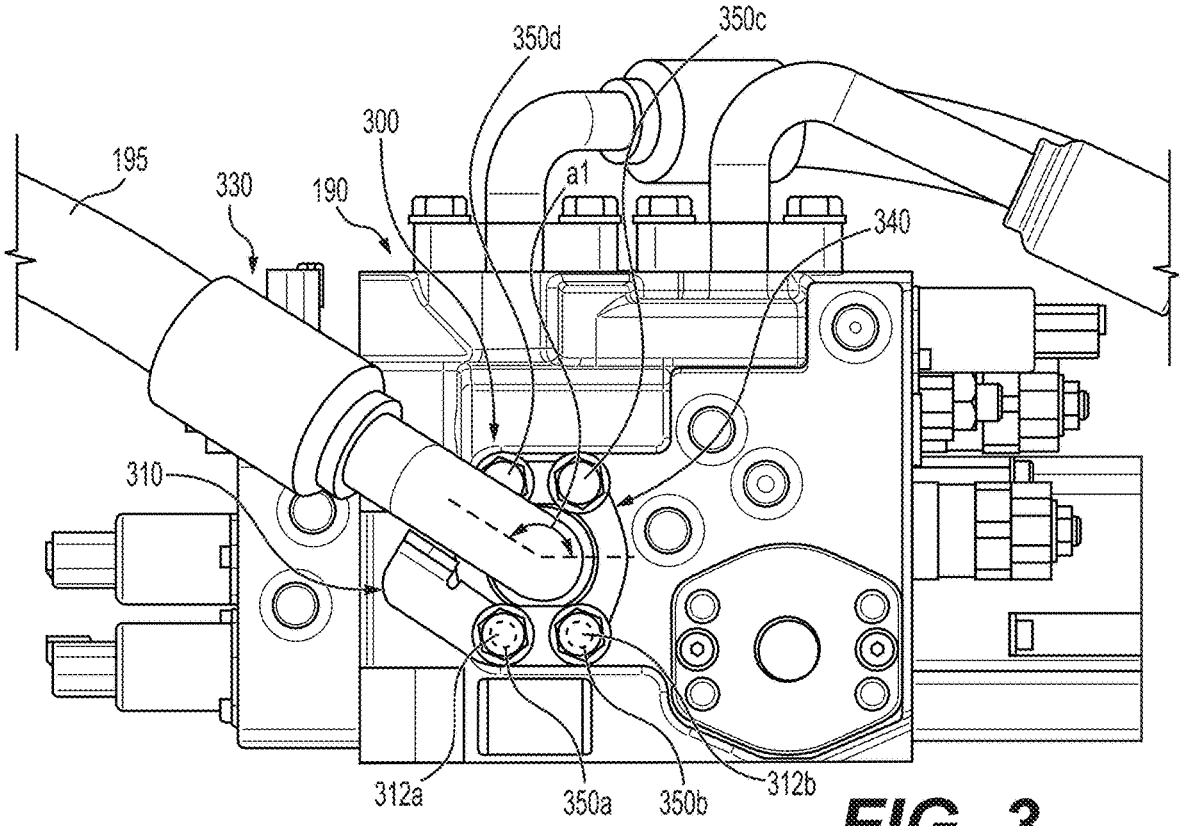
FIG. 3 is a diagram of an example hydraulic coupling connection described herein.

FIG. 3 is a diagram of an example hydraulic coupling connection 300 described herein. For example, FIG. 3 depicts a side view of an example valve 190. As shown in FIG. 3, the example hydraulic coupling connection 300 is defined between, and configured to connect, the hose 195 and the valve 190 and includes a bracket 310 for securing the hose 195 at a certain angle with respect to the valve 190 and/or with respect to other parts associated with the machine 105.

As shown in FIG. 3, the example hydraulic coupling connection 300 includes the bracket 310, a coupling 330, a split flange 340, and a plurality of fasteners 350 (350*a*-350*d*).

The bracket 310 is configured to secure the hydraulic coupling connection 300 at a first angle a1. The bracket 310 includes openings 312 (312*a*-312*b*). As shown in FIG. 3, the bracket 310 is secured with the split flange 340, via first and second fasteners 350*a*-350*b* disposed through corresponding openings 312*a*-312*b* in the bracket 310.

As indicated above, FIG. 3 is provided as an example. Other examples may differ from what was described in connection with FIG. 3.

Figure 4A:
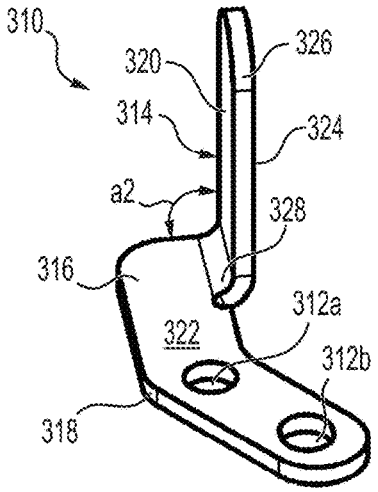
FIG. 4A is a diagram of a perspective view of an example bracket described herein.
Figure 4B:
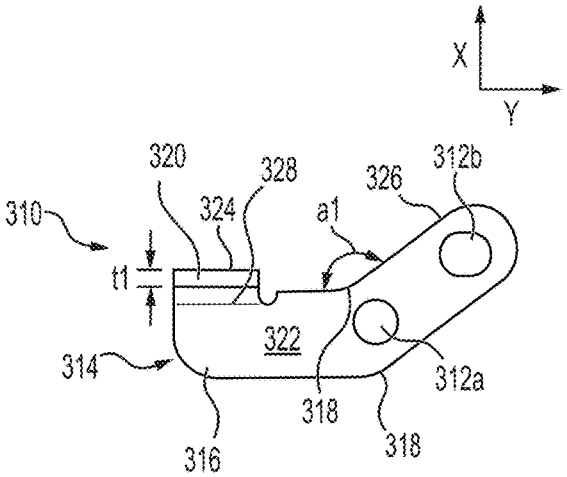
FIG. 4B is a diagram of a top view of an example bracket described herein.

FIG. 4A is a diagram of a perspective view, and FIG. 4B is a diagram of a top view, of the example bracket 310 described herein. As shown in FIG. 4A and FIG. 4B, the bracket 310 may include a one-piece body 314. The body 314 may include a first portion 316 having the openings 312*a*-312*b*. The first portion 316 may include a first bend 318 that defines the first angle a1. The first angle a1 may be from about 90 degrees to about 180 degrees (e.g., about 150 degrees). The body 314 may include a second portion 320 extending out of a plane (x-y) of the first portion 316.

The body 314 may include a first surface 322, a second surface 324 facing away from the first surface, and a third surface 326 connecting the first surface 322 and the second surface 324. As shown in FIG. 4A and FIG. 4B, the first surface 322 and the second surface 324 each include a surface extending continuously between the first portion 316 and the second portion 320 of the body 314. The first surface 322 and the second surface 324 may be parallel to each other. As shown in FIG. 4A and FIG. 4B, the first bend 318 is defined in the third surface 326.

The third surface 326 defines a thickness t1 of the body 314 measured perpendicular to the first surface 322 and the second surface 324. The thickness t1 may be uniform across the entire body 314, across the entire first portion 316, and/or across the entire second portion 320.

The body 314 includes a second bend 328 between the first portion 316 and the second portion 320. A second angle a2 of the second bend 328 is defined relative to the plane (x-y) of the first portion 316. The second angle a2 may be from about 45 degrees to about 135 degrees (e.g., about 90 degrees).

As indicated above, FIG. 4A and FIG. 4B are provided as an example. Other examples may differ from what was described in connection with FIG. 4A and FIG. 4B.

Figure 5:
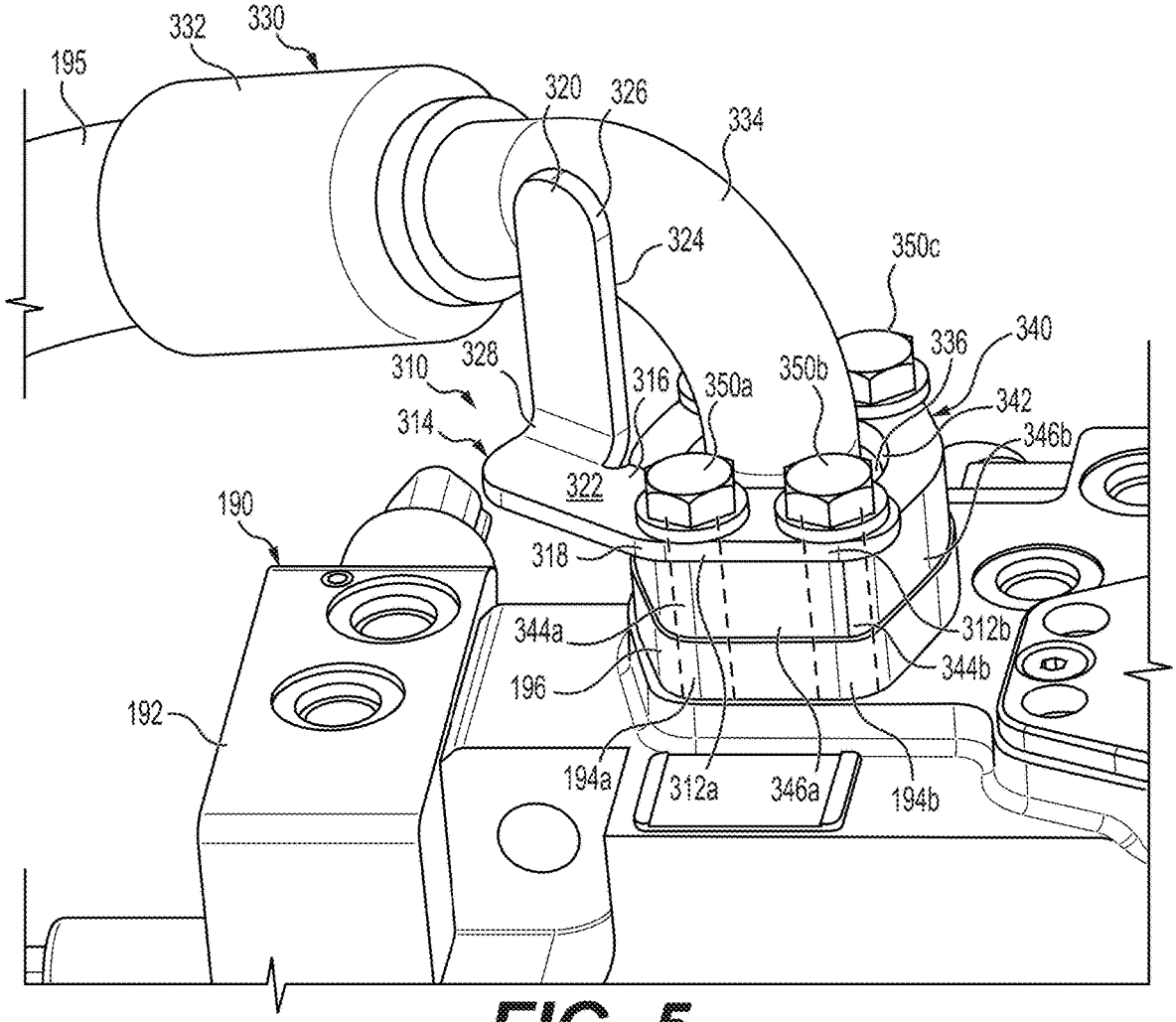
FIG. 5 is a diagram of a perspective view of an example hydraulic coupling connection described herein.

FIG. 5 is a diagram of a perspective view of the example hydraulic coupling connection 300 described herein. As shown in FIG. 5, the example hydraulic coupling connection 300 includes the bracket 310, the coupling 330, the split flange 340, and the plurality of fasteners 350*a*-350*d*.

The coupling 330 is disposed at an end of the hose 195. As shown in FIG. 5, the second surface 324 of the second portion 320 of the body 314 of the bracket 310 is engaged with the coupling 330 to secure the connection 300 at the first angle a1. In some implementations (e.g., when the bracket 310 is secured with the split flange 340, via fasteners 350*c*-350*d*, at an opposite end of the split flange 340 in relation to the example illustrated in FIG. 3), the first surface 322 of the second portion 320 of the body 314 of the bracket 310 may be engaged with the coupling 330 to secure the connection 300 at the first angle a1. As shown in FIG. 5, the coupling 330 includes a shell 332, a neck 334, and a flange 336. The shell 332 is disposed at a proximal end of the coupling 330. The shell 332 may be crimped to the end of the hose 195. The shell 332 may be brazed or welded to the neck 334. The neck 334 may be angled to facilitate connection of the coupling 330 to a body 192 of the valve 190. The flange 336 is disposed at a distal end of the coupling 330. A distal end of the flange 336 may include a flat surface and a seal configured to contact and seal with an opposing surface in the body 192 of the valve 190.

The split flange 340 is engaged with the flange 336 of the coupling 330, via an inner surface 342 that surrounds the flange 336. In some examples, a profile of the inner surface 342 may correspond to a profile of the flange 336 to facilitate pressing the distal end of the flange 336 into contact with the body 192 of the valve 190, via compression force exerted by the one or more fasteners 350, to maintain sealing contact therebetween.

The split flange 340 includes openings 344 (e.g., four total openings, of which openings 344*a*-344*b* are illustrated with dashed lines in FIG. 5). As shown in FIG. 5, the second surface 324 of the first portion 316 of the body 314 of the bracket 310 is engaged with the split flange 340. The first surface 322 of the first portion 316 of the body 314 of the bracket 310 faces away from the split flange 340. As shown in FIG. 5, the first surface 322 of the first portion 316 of the body 314 of the bracket 310 is engaged with respective head portions of the first and second fasteners 350*a*-350*b*. The split flange 340 includes two separate pieces 346*a*-346*b* that together define a wide end and a narrow end. As shown in FIG. 5, the bracket 310 is attached at the narrow end. In some examples, the bracket 310 may be attached at the wide end.

The plurality of fasteners 350 (of which fasteners 350*a*-350*c* are visible in FIG. 5) are disposed through corresponding openings 344 (of which openings 344*a*-344*b* are illustrated in FIG. 5) in the split flange 340. The plurality of fasteners 350*a*-350*d* may include corresponding washers. The plurality of fasteners 350*a*-350*d* are configured to secure the bracket 310, the split flange 340, and the coupling 330 to the body 192 of the valve 190. The plurality of fasteners 350*a*-350*d* (e.g., bolts, screws, and/or pins, among other examples) may be threaded to corresponding threaded openings 194 (e.g., four total openings, of which openings 194*a*-194*b* are illustrated with dashed lines in FIG. 5) in the body 192 of the valve 190. As shown in FIG. 5, the threaded openings 194 may be defined within a raised portion 196 of the body 192 (e.g., a boss) that is configured to align with the split flange 340.

As indicated above, FIG. 5 is provided as an example. Other examples may differ from what was described in connection with FIG. 5.

INDUSTRIAL APPLICABILITY

Machines, such as track-type tractors, and systems, such as implement control systems, may use flowlines (e.g., a hydraulic hose) to route fluid (e.g., hydraulic fluid) between different parts and/or components (e.g., a pump or valve). The hose may have a coupling at each end to secure the hose to the different components. The coupling may be secured to the respective component using a connector (e.g., a split flange). The split flange may have two separate flange pieces (e.g., identical and/or matching pieces) that combine to define the connector. The split flange may be secured to the respective component using multiple fasteners (e.g., bolts).

Generally, because the work area associated with hose coupling connections is a cramped area with little clearance, installers have to be careful that the hose does not contact other parts (e.g., other hoses or sheet metal) to avoid damage (e.g., breakage) caused by rubbing and/or vibration, which may result in fluid leakage and/or system downtime for making repairs. Generally, because the interfacing surfaces of the coupling and the connector are each rounded in shape, the connection can be set at any angle. The task of connecting the hose at a certain angle (e.g., to avoid contact with other parts) is thus inefficient, physically taxing, and time-consuming.

The hydraulic coupling connection 300 described herein reduces a physical burden and conserves time associated with connecting the hose 195 at a certain angle. For example, the bracket 310 may be used to easily secure the angle of the hydraulic coupling connection 300 with respect to the valve 190. For example, the angle of the hydraulic coupling connection 300 may be preset based on a design of the corresponding first angle a1 of the first bend 318 in the bracket 310. When the hydraulic coupling connection 300 is being made-up, the only alignment required for securing the hose 195 at the desired angle may be associated with forcing the coupling 330 into contact with the second portion 320 of the bracket 310 before tightening down the one or more fasteners 350. Additionally, the bracket 310 may limit and/or prevent rotation of the hydraulic coupling connection 300 during operation. Furthermore, it is noted that a stiffness level of the hose 195 may facilitate setting an overall shape of the hose 195 along its length, based solely on the angle of the hydraulic coupling connection 300 at one end.

As a result, the task of connecting the hose 195 at a certain angle may be more efficient, less physically taxing, and/or less time-consuming, among other examples. Additionally, a likelihood of damage to the hose 195 may be reduced.

The foregoing disclosure provides illustration and description, but is not intended to be exhaustive or to limit the implementations to the precise forms disclosed. Modifications and variations may be made in light of the above disclosure or may be acquired from practice of the implementations. Furthermore, any of the implementations described herein may be combined unless the foregoing disclosure expressly provides a reason that one or more implementations cannot be combined. Even though particular combinations of features are recited in the claims and/or disclosed in the specification, these combinations are not intended to limit the disclosure of various implementations. Although each dependent claim listed below may directly depend on only one claim, the disclosure of various implementations includes each dependent claim in combination with every other claim in the claim set.

As used herein, "a," "an," and a "set" are intended to include one or more items, and may be used interchangeably with "one or more." Further, as used herein, the article "the" is intended to include one or more items referenced in connection with the article "the" and may be used interchangeably with "the one or more." Further, the phrase "based on" is intended to mean "based, at least in part, on" unless explicitly stated otherwise. Also, as used herein, the term "or" is intended to be inclusive when used in a series and may be used interchangeably with "and/or," unless explicitly stated otherwise (e.g., if used in combination with "either" or "only one of"). Further, spatially relative terms, such as "below," "lower," "above," "upper," and the like, may be used herein for ease of description to describe one element or feature's relationship to another element(s) or feature(s) as illustrated in the figures. The spatially relative terms are intended to encompass different orientations of the apparatus, device, and/or element in use or operation in addition to the orientation depicted in the figures. The apparatus may be otherwise oriented (rotated 90 degrees or at other orientations) and the spatially relative descriptors used herein may likewise be interpreted accordingly.

What is claimed is:

1. An earthmoving machine, comprising:
- a frame;
- one or more implements mounted on the frame;
- an engine configured to power the machine;
- ground engaging members configured to propel the machine; and
- an implement control system configured to control the one or more implements, wherein the implement control system includes:
  - a pump configured to supply fluid, at pressure, to the one or more implements;
  - a valve configured to supply fluid, at pressure, from the pump, selectively to the one or more implements;
  - a first hose connected between the pump and the valve, wherein a connection defined between the first hose and the valve includes:
    - a coupling disposed at an end of the first hose, the coupling defining a fluid flow path therethrough;
    - a split flange engaged with the coupling;
    - a plurality of fasteners disposed through corresponding openings in the split flange, wherein the plurality of fasteners are configured to secure the split flange and the coupling to a body of the valve; and
    - a bracket secured with the split flange, via first and second fasteners, of the plurality of fasteners, disposed through corresponding openings in the bracket, wherein the bracket is configured to contact an exterior surface of the coupling to secure the connection at a first angle while being fluidly separated from the fluid flow path through the coupling; and
  - a second hose connected between the valve and a first implement of the one or more implements.

2. The earthmoving machine of claim 1, wherein the bracket comprises a one-piece body including:
- a first portion having the openings for the first and second fasteners,
  - wherein the first portion includes a first bend that defines the first angle; and
- a second portion extending out of a plane of the first portion,
  - wherein the second portion is configured to engage with the coupling to secure the connection at the first angle.

3. The earthmoving machine of claim 2, wherein the body of the bracket comprises:
- a first surface; and
- a second surface facing away from the first surface,
  - wherein the second surface is configured to engage with both the coupling and the split flange.

4. The earthmoving machine of claim 3, wherein the body of the bracket further comprises:
- a third surface connecting the first surface and the second surface,
  - wherein the first bend is defined in the third surface.

5. The earthmoving machine of claim 4, wherein the first surface and the second surface each comprise a surface extending continuously between the first and second portions of the body, and
- wherein the first surface and the second surface are parallel to each other.

6. The earthmoving machine of claim 5, wherein the third surface defines a thickness of the body measured perpendicular to the first surface and the second surface, and
- wherein the thickness is uniform.

7. The earthmoving machine of claim 2, wherein the body of the bracket further comprises:
- a second bend between the first portion and the second portion,
  - wherein a second angle of the second bend is defined relative to the plane of the first portion.

8. The earthmoving machine of claim 7, wherein the second angle is about 90 degrees.

9. A hydraulic coupling connection defined between a hose and a valve of a machine, the hydraulic coupling connection comprising:

a split flange configured to be engaged with a coupling disposed at an end of the hose, the coupling defining a fluid flow path therethrough;

a plurality of fasteners disposed through corresponding openings in the split flange, wherein the plurality of fasteners are configured to secure the split flange and the coupling to a body of the valve; and a bracket secured with the split flange, via first and second fasteners, of the plurality of fasteners, disposed through corresponding openings in the bracket, wherein the bracket is configured to contact an exterior surface of the coupling to secure the connection at a first angle while being fluidly separated from the fluid flow path through the coupling.

10. The hydraulic coupling connection of claim 9, wherein the bracket comprises a one-piece body including:

a first portion having the openings for the first and second fasteners, wherein the first portion includes a first bend that defines the first angle; and a second portion extending out of a plane of the first portion, wherein the second portion is configured to engage with the coupling to secure the connection at the first angle.

11. The machine of claim 10, wherein the body of the bracket comprises:

a first surface; and a second surface facing away from the first surface, wherein the second surface is configured to engage with both the coupling and the split flange.

12. The machine of claim 11, wherein the body of the bracket further comprises:

a third surface connecting the first surface and the second surface, wherein the first bend is defined in the third surface.

13. The machine of claim 12, wherein the first surface and the second surface each comprise a surface extending continuously between the first and second portions of the body, and wherein the first surface and the second surface are parallel to each other.

14. The machine of claim 13, wherein the third surface defines a thickness of the body measured perpendicular to the first surface and the second surface, and wherein the thickness is uniform.

15. The machine of claim 10, wherein the body of the bracket further comprises:

a second bend between the first portion and the second portion, wherein a second angle of the second bend is defined relative to the plane of the first portion, and wherein the second angle is from about 45 degrees to about 135 degrees.

16. An apparatus for a hydraulic coupling connection defined between a hose and a valve of a machine, the hydraulic coupling connection including a split flange configured to be engaged with a coupling disposed at an end of the hose, the apparatus comprising:

a bracket configured to be secured with the split flange, via first and second fasteners, of a plurality of fasteners, wherein the bracket is a solid plate, wherein the first and second fasteners are configured to be disposed through corresponding openings in the bracket, the split flange, and a body of the valve, and wherein the bracket is configured to contact an exterior surface of the coupling to secure the connection at a first angle.

17. The apparatus of claim 16, wherein the bracket comprises a one-piece body including:

a first portion having the openings for the first and second fasteners, wherein the first portion includes a first bend that defines the first angle; and a second portion extending out of a plane of the first portion, wherein the second portion is configured to engage with the coupling to secure the connection at the first angle.

18. The apparatus of claim 17, wherein the body of the bracket comprises:

a first surface; and a second surface facing away from the first surface, wherein the second surface is configured to engage with both the coupling and the split flange.

19. The apparatus of claim 18, wherein the body of the bracket further comprises:

a third surface connecting the first surface and the second surface, wherein the first bend is defined in the third surface.

20. The apparatus of claim 19, wherein the first surface and the second surface each comprise a surface extending continuously between the first and second portions of the body, wherein the first surface and the second surface are parallel to each other, wherein the third surface defines a thickness of the body measured perpendicular to the first surface and the second surface, and wherein the thickness is uniform.

* * * * *